US006520504B2

(12) United States Patent
Loder

(10) Patent No.: US 6,520,504 B2
(45) Date of Patent: Feb. 18, 2003

(54) GAME

(76) Inventor: John Loder, 19 Pemberton Street East Parramatta, New South Wales, 2150 (AU)

( * ) Notice: Subject to any disclaimer, the term of this patent is extended or adjusted under 35 U.S.C. 154(b) by 0 days.

(21) Appl. No.: 09/901,536

(22) Filed: Jul. 9, 2001

(65) Prior Publication Data

US 2001/0035612 A1 Nov. 1, 2001

Related U.S. Application Data

(63) Continuation of application No. 09/314,799, filed on May 19, 1999.

(51) Int. Cl.[7] ..... A63F 1/00
(52) U.S. Cl. ..... 273/292; 273/139; 273/430
(58) Field of Search ..... 273/138.1, 146, 273/292, 293, 296, 299, 300, 301, 302, 308, 139, 429, 430, 431

(56) References Cited

U.S. PATENT DOCUMENTS 387,220 A * 8/1888 Forker
1,264,508 A * 4/1918 Heartt et al.
1,373,998 A * 4/1921 Dillon
4,558,865 A * 12/1985 Isgar
4,684,135 A * 8/1987 Bouchal
4,735,419 A * 4/1988 Koca
4,927,147 A * 5/1990 Delzio
4,940,239 A * 7/1990 Tuttle
5,193,818 A * 3/1993 Leeson
6,065,749 A * 5/2000 Debie

* cited by examiner

*Primary Examiner*—Benjamin H. Layno
*Assistant Examiner*—V K Mendiratta
(74) *Attorney, Agent, or Firm*—Cesari & McKenna, LLP

(57) ABSTRACT

A game played for amusement is disclosed. The game requires a response to trigger information that remains hidden until a predetermined theme information has been selected. A player that correctly matches or, by agreement of one or more player(s) or an operator, most closely matches the trigger information to the randomly selected predetermined theme information is the winner. Numerous repeats of the game can be performed, the ultimate winner being the player that has correctly identified the most trigger information to the randomly selected predetermined themes. The game may be played using cards and dice, using on computer(s) or in other forms. Such an embodiment may be particularly appropriate as a travel game printed on a card, in an airline magazine or in other book form. Where a response is desired to be submitted, this may be done via a communications means such as mail, fax, or the like.

9 Claims, 1 Drawing Sheet

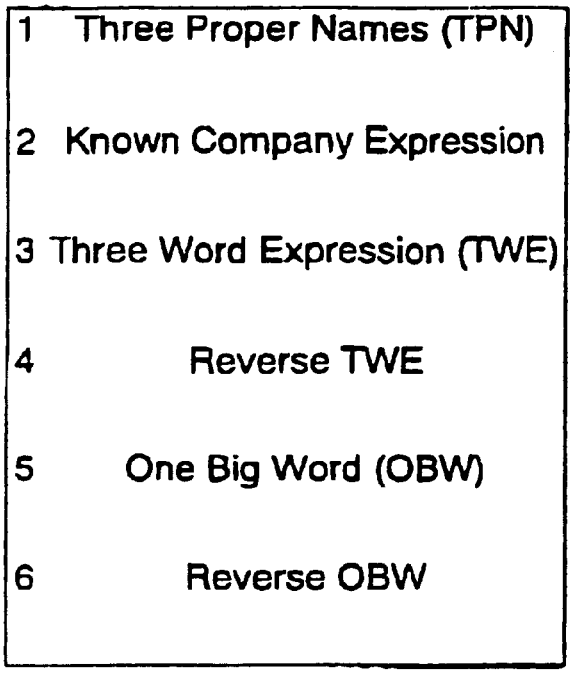

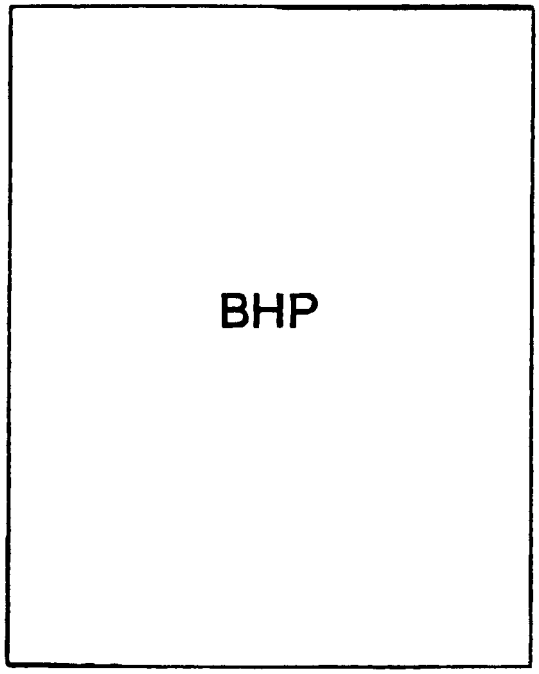

1 Three Proper Names (TPN)

2 Known Company Expression

3 Three Word Expression (TWE)

4 Reverse TWE

5 One Big Word (OBW)

6 Reverse OBW

FIGURE 1

BHP

FIGURE 2

GAME

RELATED APPLICATION

This application is a Continuation of Ser. No. 09/314,799, filed May 19, 1999.

FIELD OF THE INVENTION

This invention relates to a game played for amusement where a response is made to a revealed trigger information in context to a randomly selected predetermined theme.

BACKGROUND OF THE INVENTION

Various question and answer format quiz games are presently known. A variety of such games are broadcast on television and radio, and are also known in a play-at-home format. For example, 'Trivial Pursuit' is one such game, wherein a plurality of question-and-answer procedures test the general knowledge of the players.

While such known games provide a certain amount of entertainment, there is a need to provide a game which relies less on the general knowledge of the players, and which, instead, requires a higher level of intellectual involvement and/or creativity in identifying and/or supplying a winning response.

SUMMARY OF THE INVENTION

The present invention provides a game which seeks to require a higher level of intellectual involvement and/or creativity in a player identifying and supplying a winning response, consequently providing educative and amusement value.

The present invention also provides a game which is suitable for playing on a number of playing mediums, for example, using one or more cards or other printed matter or using one or more computer(s).

In one broad form, the present invention provides a method of playing a game including the steps of:

providing selected theme information to a one or more player(s);

providing selected trigger information to said player(s); and, the or each player submitting a response;

whereby the game is completed, and a winner may be determined when a player's response best matches the trigger information to the theme information.

Preferably, said game is played by distributing at least one of a plurality of cards to each player(s), each card having said theme information displayed on one face thereof and varying trigger information on the opposed face thereof.

Also preferably, each card is provided with a group of theme information displays thereon, and wherein said method further includes the steps of selecting said theme information from said group by rolling a die or the other random generating means.

In a preferred form, said game is played on at least one computer and wherein said theme and/or trigger information are selected randomly by the computer(s), an operator, or a player(s).

In a preferred embodiment, there are two or more player (s).

Preferably, in this form said game is played on a plurality of networked computers (intranet or internet), whereby a player submits said response to an operator or to the other player(s).

In a further preferred form, said theme and trigger information are provided on a display media, such as on a printed card or in a book form.

Preferably, each response is submitted via mail, fax or via any other communications means.

In a further broad form, the present invention provides a game including:

means for displaying theme information to at least one player(s); and, means for displaying trigger information to said player(s);

wherein, the or each player submits a response seeking to finish/win the game by matching the theme information correctly or most creatively to the trigger information.

Preferably, theme information is displayed on one face of each of a plurality of cards whilst varying trigger information is displayed on each opposed face of said cards, characterised in that at least one card is distributed to each player in a manner such that the information themes are displayed.

Also preferably, each card is provided with a group of theme information displays thereon, and wherein said game further includes the step of rolling a die or the like to randomly select said theme information from said group.

In a preferred embodiment, said game is played on at least one computer, and said theme and/or trigger information are selected randomly by the computer(s), and operator, or a player(s).

In a preferred embodiment, there are two or more player (s).

In a most preferred form, said game is played on a plurality of networked computers (intranet or internet), whereby each player submits a response to an operator or to the other player(s).

In a further preferred form, the theme information and trigger information is provided on a display media, such as on a printed card or in a book form.

Preferably, each response is submitted via mail, fax or via other communications means.

BRIEF DESCRIPTION OF THE DRAWINGS

The present invention will become more fully understood from the following detailed description of preferred but non-limiting embodiments thereof, described in connection with the accompanying drawings, wherein:

FIG. 1 shows a first face of a card, displaying a predetermined group of 'theme information'; and, FIG. 2 shows one example of an opposed face of the card of FIG. 1, displaying a 'trigger information'.

DETAILED DESCRIPTION OF PREFERRED EMBODIMENT(S)

The composition, articulation and conclusion of a first embodiment of this game is described in the following instructions.

The composition of this first embodiment of the game may include, but is not limited to, a plurality of cards each of which has the same set of predetermined themes printed on the "displayed" surface of all the cards and unique "trigger" information printed on the opposed "hidden" surface of each card, and, at least one die having unique symbols on each face.

Articulation of the game, for this embodiment, may be performed by the following steps:

Step 1: Distributing one or more of the plurality of cards evenly between a plurality of players, so that after the distribution, each of the plurality of players has a pile or deck of cards arranged, such that the predetermined themes are displayed, as shown in FIG. 1;

Step 2: One player rolls the die and generates a random symbol;

Step 3: All the other players match the resultant symbol from the die with the corresponding predetermined theme displayed on the deck of their own arranged cards;

Step 4: The player that rolled the die, then turns over the first (top most) card from his/her own deck of arranged cards, so revealing to all the other players, the "hidden" trigger information, such as shown in FIG. 2;

Step 5: All the players except the one that rolled the dice, must provide an answer or response that, on general agreement from all the players, correctly or most creatively matches the trigger information to the predetermined theme that was determined by the randomly generated unique symbol of the dice;

Step 6: The player that provides the correct or generally agreed correct or best answer to the revealed trigger information, is handed that card which had the trigger information, and this card is set aside by this player; and, Step 7: This player who correctly or best answers, is then the player to roll the dice as in step 2 and the game continues until all distributed cards have been used to provide trigger information. At this point, the player who has set aside the most cards from answering correctly or most creatively is declared the winner.

It will be appreciated by persons skilled in the art that numerous variations of this embodiment may be made. Such variations may include, but are not limited to the following:

The number of predetermined themes can be other than six, so that a random generator other than a conventional, one die can be used.

When the predetermined theme is matched with the number on the die or the like, the player who rolled the die or generated the random number can make further definitions of what answer is required. For example, if the 'theme information' three proper names were determined from the die (theme 1 as shown in FIG. 1 for example), the player who rolled the die could further defined that the proper names must be the names of towns.

Alternatively, instead of the player that rolled the die determining further requirements before the trigger information is revealed, it could be the remaining players that determine what will be the acceptable proper names, such as Australian rivers.

In a preferred embodiment, the game may be played to determine whether the players are aware of jargon or abbreviations. For example, jargon such as three letter abbreviations used in the computer industry or other specialised industry may be the object of the game.

In such an embodiment, the game pieces may include an ordinary six sided cube with numbers on it, commonly known as a die, and, a set of game cards.

On the face side of each game card, six particular themes may be displayed, and, on the "hidden" side, a set of three letters may typically be displayed.

To play the game, say with three or more players, the cards are evenly distributed to all the players. Each player preferably makes a neat pile of their cards face side up.

After all the cards are distributed, a player picks up the die and rolls it. The number generated is then used to select the numbered theme on the face side. When everybody has matched the die number with the theme, the one who rolled the die turns over the top card from his/her own pile of cards and displays the three letters printed on the hidden side. The first person to give a response, that is agreed to be the best answer, wins that card. This winner sets that card aside as a "win" and rolls the die to repeat the game.

It should be noted that the one who rolled the die should not answer in that round if there are more than two players, due to the fact that they could be called upon to judge which answer was best or first to be called. This becomes important when a large group of people are playing. Additionally, this person can suggest, before turning over the hidden letters, a very specific answer. For example, the theme to be answered could be "Three Proper Names". Therefore, the one who rolled the die could ask that the Three Proper Names must be, for example, the names of towns in Australia. After all player's cards are all turned over, the "winner" may be selected as the one who has collected and set aside the most "wins".

Numerous variations and modifications will become apparent. For example, when there are only two players the cards may be left in one pile face side up. Each player takes turns in rolling the die. After the die is roller, the top card is turned over by the other player, and both try to beat each other to give an answer.

An alternative variation, suitable for one player, is to, from the pile of cards, turn one over at a time and see how quickly the player can answer all six themes.

Another alternative variation for one player is when the themes and trigger information are displayed on one page/screen and the player is set a time limit to find appropriate answers to all the given themes. Such an embodiment may be particularly appropriate as a travel game printed on a card, in an airline magazine or in other book form. Where a response is desired to be submitted, this may be done via a communications means such as mail, fax, or the like.

A further preferred embodiment of the invention, the game may be played on at least one computer, whereby the theme information and/or the trigger information may be randomly generated by the computer, by an operator, or by one or more of the players. The game may be played by a single player competing against his/her computer, or by a plurality (being two or more) players on a single or linked computers. The computers may be linked in any known manner, including via a network, either intranet or internet.

Articulation and conclusion of the game is similar to the previously described embodiment, except that the theme and trigger information is dispatched for display by the player(s) in electronic form, and the answers are provided to the computer, the remote operator or to the other player(s), by the player entering his/her response via a keyboard or other interface which is then transmitted for determination of the winning response.

The categories of predetermined themes may be transmitted (be electrical, radio, RF or other means) to all the players. Also a random number generator program and set of three letter abbreviation "trigger displays" may be distributed to all players or may be controlled by a non-playing operator or gaming establishment. The themes are stored and displayed on each players receiving and displaying equipment, while the set of 3 letters is held as a data file and only displayed when called. One player, or the non-playing operator, runs the program to generate a random number and the result is transmitted to all other players. The player or operator who generated a number, by another random selection method, retrieves a single set of three letter triggers from the stored data base, and the retrieved set of triggers is transmitted to all the players. If the players are in the same room and have elected to allow verbal responses, then the first player that verbally calls out an answer to the three letters to its corresponding theme, will be awarded some acknowledgement and be described the 'winner'. In the situation where it is one of the players who runs the program, the 'winner' then for the next round becomes the player to randomly generate a number and select one set of three letters from the data base. If the players are at isolated locations, then the player that transmits a suitably correct answer to the triggers, back to the player that supplied the triggers, is acknowledged as the winner.

An Internet version though similar could typically have either a static or dynamic form.

With a static version, accessing a game web page will show the set of predetermined themes, dialogue boxes placed next to each theme, and, one box identified with "click" or a similar instruction to input a "begin" response. On clicking the box, a request is made to select from a server, the three trigger letters that have been placed there and updated at regular intervals. The three trigger letters are sent back to the person's game web page, where the themes and dialogue boxes are displayed, and the person must answer all six themes in relation to the supplied set of trigger letters. A submit button can then be clicked to transmit the answers to a moderators server. In this form of the game, it really is any number of players submitting at anytime a response to a modulator who at regular intervals can E-mail back (or send back via unique URLs created by cookies when accessing the "click" button of the player's game page) to the person that their submission was the best out of all the players. All players may have their page refreshed with the best answer for each theme and then displayed underneath their own answer to compare with.

The dynamic form of this game is similar except that the moderator is online and the responses made by each player are visible to the other players by virtue that the page is in XTML format allowing dynamic dialogue boxes to be displayed to any other person reading the same page. In this form, maybe 8 or more XTML boxes are displayed for 8 or more multi players whom all can see who wrote first and possibly allow voting to be done to determine the winner, with a moderator deciding on any tied results.

It will be appreciated by persons skilled in the art that numerous variations and modifications may be made to the invention to embody it in a computerised format. For example, instead of rolling a die, a random number generator may be used, and the responses may be determined to be correct by an operator, the other players, or by the computer analysing the response and correlating same with information in an electronic dictionary or the like.

All such variations and modifications to the invention should be considered to fall within the scope of the invention as hereinbefore described as a hereinafter claimed.

The claims defining the invention are as follows:

1. A method of playing a game, the game being played by a plurality of player consisting of one changing dealer and remaining player(s), said method including the steps of:

distributing an equal number of cards to a plurality of players, wherein each card includes a top-face having a common set of indicia and with an instruction corresponding to each indicia, and, a bottom-face, each card having a different letter information trigger on its bottom face, said distributed cards being stacked top-face up in piles;

said dealer generating a random symbol from a set of random symbols using a random-symbol generator such as a die;

said remaining player(s) correlating the randomly-generated symbol to it's respective uniquely corresponding indicia and instruction on said top face of said cards;

said dealer revealing to the remaining player(s) the unique three-letter information trigger on a card at the top of the dealer's card pile;

each of said remaining player(s) submitting a response which includes the three-letter information trigger and which is relevant to the selected instruction, wherein the player who submits the best response is awarded the card which contained the information trigger, and now replaces the designated dealer as the new dealer;

wherein the game is completed and a winner is determined when a player has set aside a predetermined number of cards, or when all cards have been used, the winner having the most cards.

2. A method of playing a game as, claimed in claim 1, wherein the top face of each card includes a set of six indicia and instructions.

3. A method of playing a game as claimed in claim 1, wherein the best response is decided by the dealer.

4. A method of playing a game as claimed in claim 1, wherein the best response is decided by the agreement or popular choice of all the players.

5. A method of playing a game as claimed in claim 1, wherein there are at least two players.

6. A game to be played by a plurality of players consisting of one changing dealer and remaining player(s), said game including:

a plurality of cards, each card having a top-face having a common set of indicia and an instruction corresponding to each indicia thereon, each card also having a bottom-face having a different three-letter information trigger thereon; and a random symbol generator, such as a die, wherein each symbol corresponds to one of said indicia and instructions displayed on said top face of said cards;

wherein said game is played by;

distributing one or more of said plurality of cards between a plurality of players, said distributed cards being stacked top-face up in piles;

said dealer generating a random symbol using said random-symbol generator;

said remaining player(s) correlating the randomly-generated symbol to a corresponding indicia and instruction on the top faces of said cards;

said dealer revealing to the remaining player(s) the unique three-letter information trigger of a card at the top of dealer's card pile;

each of said remaining player(s) submitting a response which includes the three-letter information trigger and which is relevant to the selected instruction, wherein the player who submits the best response is awarded the card which contained the information trigger, and now replaces the designated dealer as the new dealer;

wherein the game is completed and a winner is determined when a player has set aside a predetermined number of cards or when all cards have been used, the winner having the most cards.

7. A game as claimed in claim 6 wherein the top face of each card includes a common set of six indicia and instructions.

8. A game as claimed in claim 6, wherein the best response is decided by the dealer.

9. A game as claimed in claim 6, wherein the best response is decided by the agreement of all the players.

* * * * *